United States Patent [19]

Perkin

[11] 4,282,941

[45] Aug. 11, 1981

[54] UNDERREAMER WITH LARGE CUTTER ELEMENTS AND AXIAL FLUID PASSAGE

[75] Inventor: Gregg S. Perkin, Redondo Beach, Calif.

[73] Assignee: Smith International Inc., Newport Beach, Calif.

[21] Appl. No.: 31,170

[22] Filed: Apr. 18, 1979

[51] Int. Cl.[3] ..... E21B 9/26

[52] U.S. Cl. ..... 175/267; 175/269

[58] Field of Search ..... 175/267, 268, 269, 284, 175/286, 287, 289

[56] References Cited

U.S. PATENT DOCUMENTS

| | | | |
|---|---|---|---|
| 2,941,785 | 6/1960 | Kammerer | 175/267 |
| 3,347,323 | 10/1967 | Sharp | 175/269 |
| 3,406,769 | 10/1968 | Kammerer, Jr. | 175/269 |
| 3,483,934 | 12/1969 | Fuchs | 175/267 |
| 3,749,187 | 7/1973 | Leathers | 175/269 |
| 4,187,920 | 2/1980 | Johnson | 175/267 |

*Primary Examiner*—James A. Leppink

*Attorney, Agent, or Firm*—Christie, Parker & Hale

[57] ABSTRACT

A subsurface borehole underreamer comprises a tubular body which is adapted at its upper end for coaxial connection to a rotary drill string. A plurality of cutter support arms have upper and lower ends. The upper ends of the arms are pivoted to the body for motion of the lower ends thereof between retracted positions, in which the lower ends are disposed essentially within the diameter of the body, and open positions, in which the arm lower ends are disposed outwardly of the body. Cutters are mounted to the lower end of each arm and are configured to extend essentially to the center of the body when the arm is in its retracted position. An actuator in the body is selectively operable for moving the arms from their retracted to their open positions. The actuator includes an open ended tubular element which is movable downwardly in the body coaxially thereof during operation of the actuator from an upper position, wherein the lower end of the tubular element is disposed in the body above the locations occupied by the cutters in their retracted positions, to a lower position, wherein the lower end of the tubular element is disposed below said cutter location. The body has a fluid flow passage therealong comprised of upper and lower axial passage sections, respectively, above and below the retracted positions of the cutters. When the arms move to their open position, the tubular element moves past the retracted position of the cutters to connect the passage upper and lower sections axially of the body in fluid flow relation.

26 Claims, 12 Drawing Figures

UNDERREAMER WITH LARGE CUTTER ELEMENTS AND AXIAL FLUID PASSAGE

BACKGROUND OF THE INVENTION

1. Field of the Invention

This invention pertains to subsurface borehole underreamers. More particularly, it pertains to underreamers having large cutter elements and providing a fluid flow passage axially of the length of the underreamer in the opened state of the underreamer.

2. Prior Underreamers and Their Problems

A subsurface borehole underreamer is a tool which is used to enlarge a portion of the length of a hole drilled in the earth below a restriction in the hole. Such tools are used in drilling oil, gas, water, mining, and construction holes and wells, and also in the formation of shotholes for blasting. An underreamer has two operative states, a collapsed or closed state in which the tool diameter is sufficiently small to allow it to be moved in the hole past the restriction, and an opened or expanded state in which the diameter of the tool corresponds to the desired greater diameter to which the hole is to be enlarged below the restriction. As the tool is opened, one or more arms, hinged at their upper ends to the tool body and carrying suitable cutters at their lower ends, pivot out from the body to position the cutters for enlargement of the hole as the tool is thereafter operated; such operation includes rotating the tool and lowering it as it is rotated.

Underreamers are now of two general types, the so-called rock-types and drilling types. Rock-type underreamers are used where the entire length of the borehole, at least over the length thereof to be underreamed, has previously been drilled. Rock-type underreamers have large cutters which extend in the body to its center when the tool is closed; in such tools it is not required that a circulating fluid (air or a suitable liquid) flow axially through the tool from end to end. In drilling-type underreamers, on the other hand, it is required that a circulating fluid flow from end to end of the tool when it is opened. Drilling-type underreamers, therefore, use smaller cutters which, when the tool is closed, do not fully extend to the center or axis of the tool, thereby providing room in the tool for the definition of a circulating fluid duct past the retracted position of the cutters. In a drilling-type underreamer, the cutters are located between the exterior of the circulation duct and the exterior of the tool body when the tool is closed. Rock-type underreamers, therefore, enable a hole of given diameter to be enlarged to a greater diameter than do drilling-type underreamers due to the fact that they incorporate larger cutters within the interior of the tool body than a drilling type underreamer.

A drilling-type underreamer usually is used in conjunction with a drill bit below the underreamer. The underreamer is a lower component of a string of rotary drill pipe, and the drill bit is carried at the lower end of the string. The drill bit forms the hole to be underreamed at the same time that the underreamer enlarges the hole formed by the bit. Circulation of fluid must be provided to the drilling bit to remove cuttings created by the bit as it is operated.

The advantages of existing rock-type underreamers are that they enable the use of the largest possible cutters within the confines of the tool body, and they afford maximum expanded diameter for a given size of the tool body; their disadvantages are that they provide no communication of circulating fluid below the tool, no direct fluid wash is provided to the cutters as they are operated, and it is not possible to use hydraulically or non-hydraulically actuated tools below such underreamers. The advantages of drilling-type underreamers are that they provide fluid communication below the tool, they enable the provision of a fluid wash on the underreamer cutters, and they enable the use of hydraulically or non-hydraulically actuated tools in the drill string below the underreamers; their disadvantages are that, for a given tool size, they can accommodate within the confines of the tool body only smaller cutters, and, therefore, their expanded diameter is limited as compared to rock-type underreamers.

A need exists for an underreamer which provides the advantages of both rock-type and drilling-type underreamers without the disadvantages of either type. Ideally, the underreamer should be useful with both conventional circulation and reverse circulation. Conventional circulation involves the flow of circulation fluid (air or drilling mud) down the center of the drill string and up the annulus between the exterior of the drill string and the borehole. In reverse circulation, the circulating fluid flows down the borehole annulus along the exterior of the drill string or through the annulus of a dual-tube type drill string, and then up the interior of the drill string.

SUMMARY OF THE INVENTION

This invention is addressed to the need identified above. It provides a borehole underreamer which combines the advantages of present rock-type and drilling-type underreamers with none of the disadvantages of either. The present underreamer includes cutters of the larger size heretofore found only in rock-type tools while also providing an axial flowpath through the length of the tool for circulating fluid. The new underreamer can be used with conventional circulation or reverse circulation. It can be used advantageously with one or more other underreamers in a serial arrangement in a drill string. The underreamer, in its presently preferred form, can be altered readily to change its effective size, thereby providing a very versatile tool. It is structurally and functionally simple, and it is rugged.

Generally speaking, this invention provides a borehole underreamer which includes a tubular body which is adapted at its upper end for coaxial connection to a rotary drill string. A plurality of cutter means support arms, having upper and lower ends, are provided. The arms are disposed at selected locations around the circumference of the body at a selected point therealong. The arms are connected at their upper ends to the body for pivotal motion relative to the body. The arms are movable between retracted positions in which the arms are disposed essentially within the outer diameter of the body and opened positions in which the arm lower ends are disposed a selected distance outwardly of the exterior of the body. Cutter means are mounted to the lower end of each arm. The cutter means are configured to extend essentially to the center of the body when the respective arm is in its retracted position. Actuator means are disposed in the body and are selectively operable for moving the arms from their retracted to their opened positions. The actuator means includes an open ended tubular element which is movable downwardly in the body coaxially thereof during operation of the actuator means. The tubular element has an upper position, wherein the lower end of the tubular element is disposed above the locations occupied by the cutter means when they are retracted. The tubular element also has a lower position wherein the lower end of the element is disposed below the retracted locations of the cutter means. A fluid flow passage in the body is comprised of upper and lower axial passage sections, disposed respectively above and below the retracted location of the cutter means. The lower passage means includes means cooperable with the lower end of the tubular element, in the lower position of the element, for connecting the passage upper and lower sections in fluid flow relationship.

DESCRIPTION OF THE DRAWINGS

The above-mentioned and other features of this invention are more fully set forth in the following detailed description of certain embodiments of the invention, including the presently preferred embodiment, which description is presented with reference to the accompanying drawings, wherein:

FIG. 1 is comprised of FIGS. 1A, 1B, 1C, 1D and 1E, which, when considered in serial arrangement with FIG. 1A to the right, and FIG. 1E to the left, show the illustrated underreamer in its two operative states, namely, in its closed state below the center line of the underreamer and in its open state above the center line;

FIG. 3, composed of drawings

DESCRIPTION OF THE ILLUSTRATED EMBODIMENTS

Figures 1A, 1B:
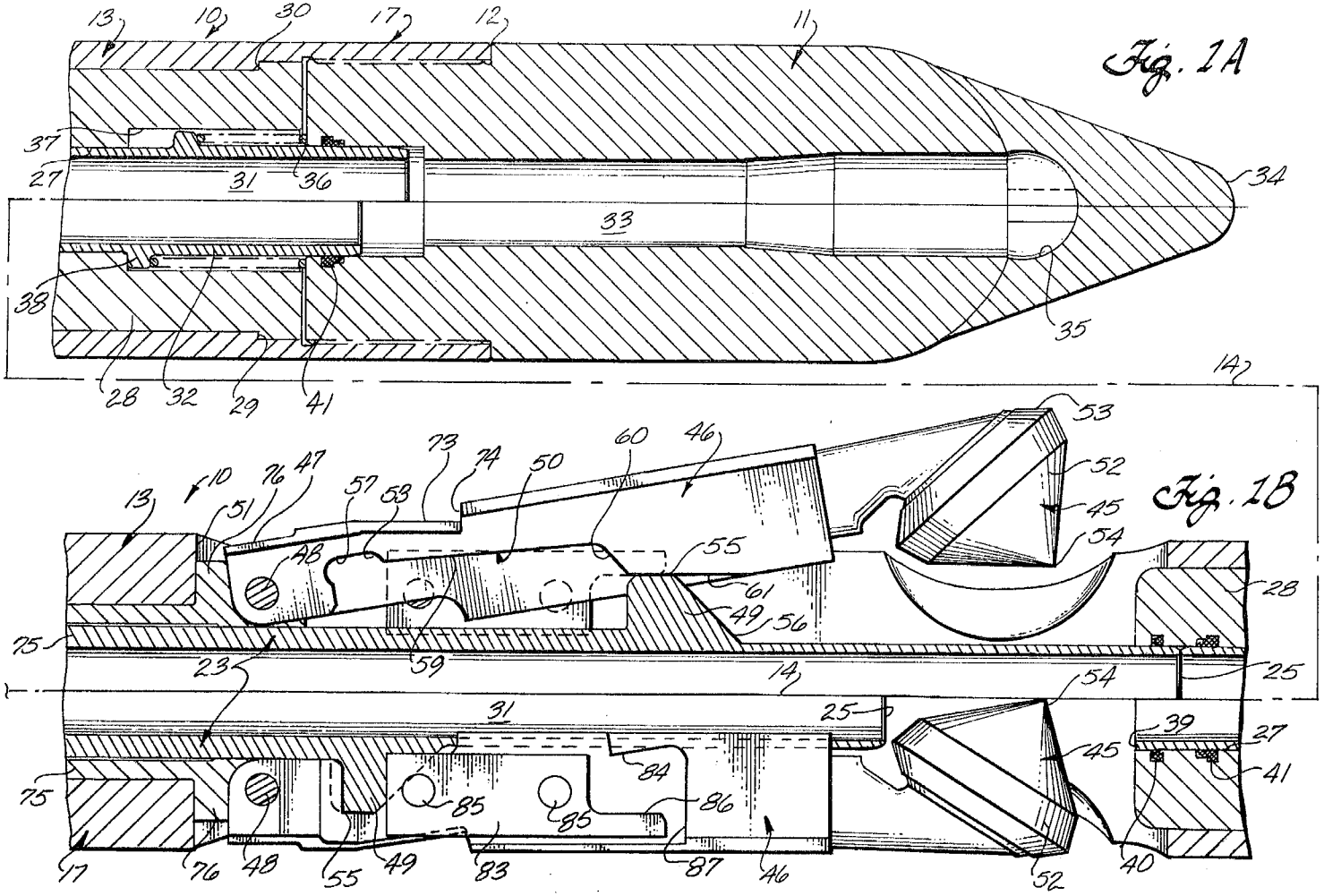
FIG. 1 is a cross-sectional elevation view of an underreamer according to this invention.

FIGS. 1A–1E together comprise FIG. 1 hereof which illustrates an underreamer 10 having a bullnose assembly 11 connected to a lower end 12 of a body 13 of the underreamer. The underreamer body 13 is an elongate straight tubular structure having a center line axis 14. The body is defined of three serially connected components, namely, a top filter sub (subassembly) 15, an upper body sleeve 16 which is sometimes herein called a piston sub (subassembly), and a lower body sleeve 17 which is somtimes herein called an arm sub (subassembly). The top filter sub, the piston sub, and the arm sub are threadably interconnected at 18 and 19 to define the overall underreamer body. The lower end 12 of the underreamer body is defined by the internally threaded lower end of arm sub 17, and the upper end 20 of the body is defined by an externally threaded pin portion 21 at the upper end of the top filter sub 15.

Bullnose assembly 11 is shown in FIG. 1A for the purposes of example. Because of the properties of the underreamer, it could equally well be connected in use at it lower end to a rotary drill bit.

In FIG. 1 the underreamer is shown above axis 14 in it sopen or expanded state, and is shown in its closed or retracted state below axis 14.

Figure 1C:
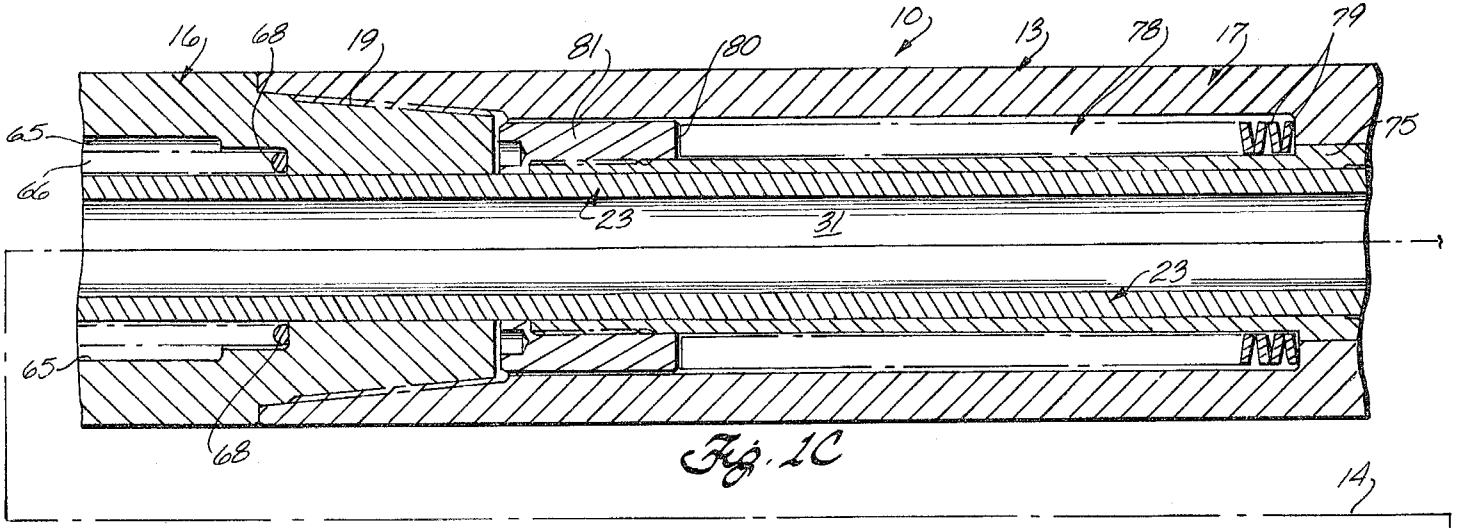
Figure 1D:
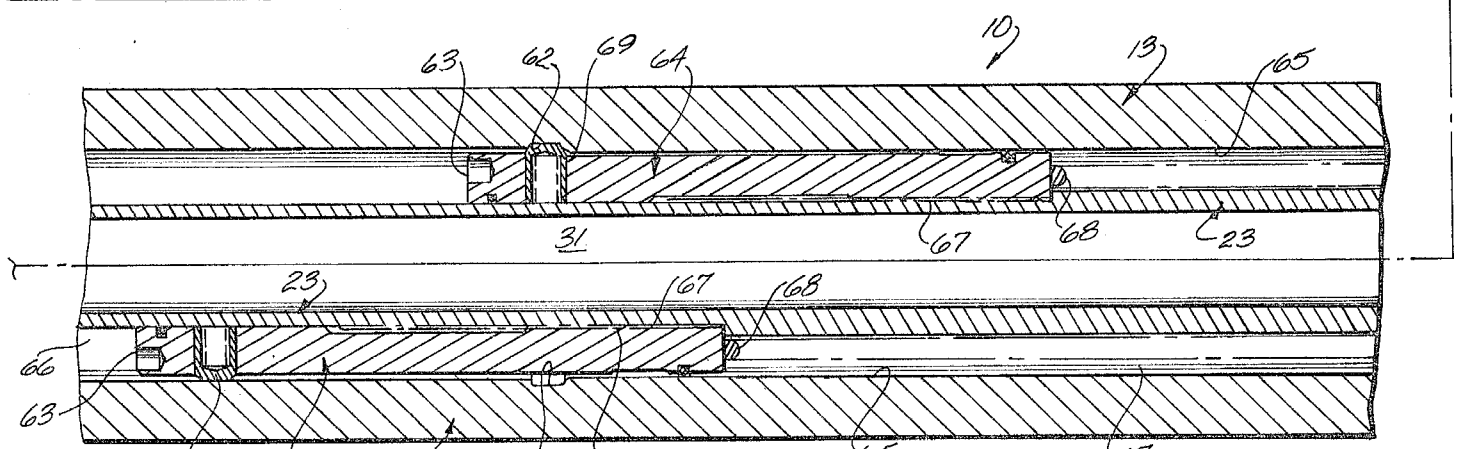
Figure 1E:
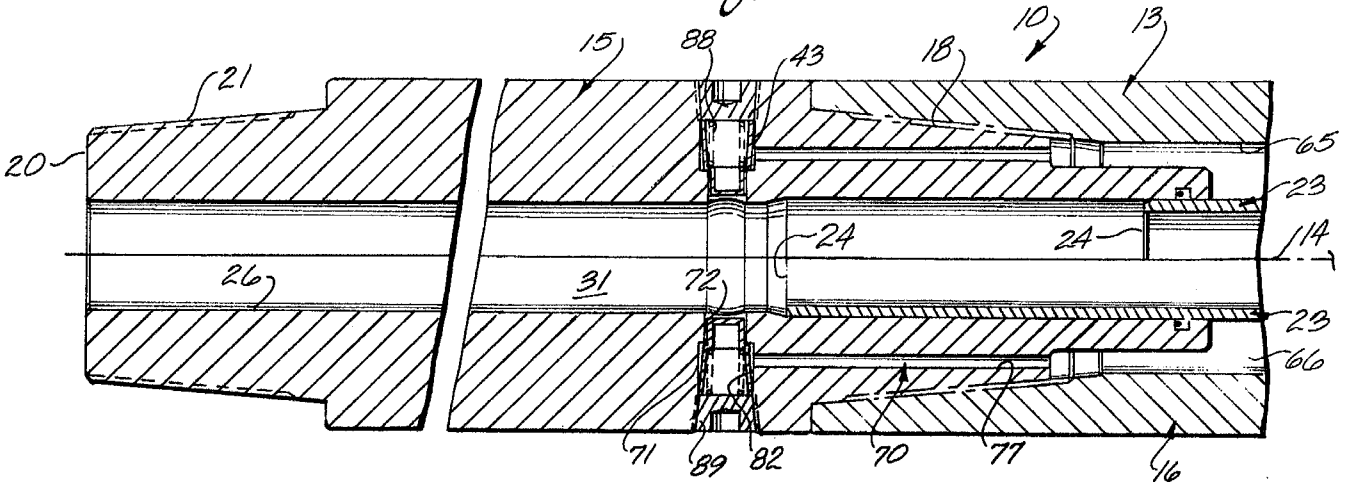
Figure 2:
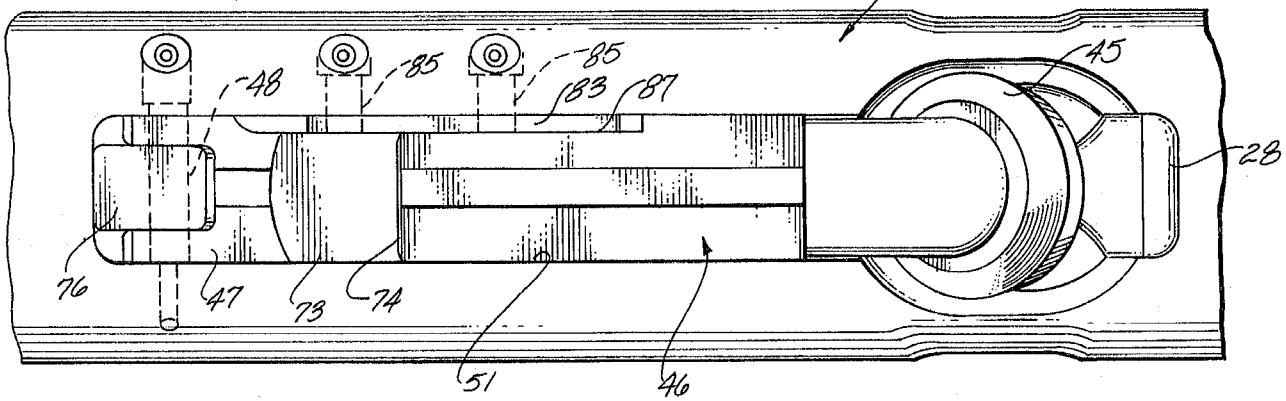
FIG. 2 is a fragmentary elevation view of portion of the underreamer shown in FIG. 1B.

Underreamer 10, according to this invention as shown in FIGS. 1 and 2, may have an outer diameter of 7.25 inches and an overall length between its upper and lower ends 20 and 12 of 9 feet 5.75 inches.

The upper end of the body is adapted, as by the external threads of pin portion 21, to be connected to a string of drill pipe or to suitable components of a drill string, such as a drilling collar. In use, the underreamer preferably is located at, or closely adjacent to, the lower end of the drill string.

An elongate tubular cam sleeve 23 is disposed within body 13 concentrically about axis 14 and is slidably movable along the length of the underreamer relative to the body. The cam sleeve is hollow and is open at its upper and lower ends 24 and 25, respectively. The cam sleeve has a length which is greater than the length of either of the piston sub or the arm sub, so that the upper end 24 of the cam sleeve is always directly associated with an axial bore 26 through filter sub 15, and the lower end of the cam sleeve is always associated with a lower portion of the arm sub, as shown in FIGS. 1E and 1B, respectively The lower end 25 of the cam sleeve is movable along axis 14 into and out of cooperation with an axial bore 27 which is defined in a seal protector housing 28. Housing 28 is disposed coaxially in the underreamer in the body in association with its lower end 12. The seal protector housing is held axially in position within body 13 by internal and external shoulders 29 and 30 on the body and seal protector housing, respectively, and by cooperation with the upper end of bullnose 11 or whatever other component of the drill string which is connected to the lower end of the underreamer in use.

Filter sub bore 26 and the inner diameter of the cam sleeve 23 define an upper section of an axial fluid passage 31 through the underreamer. Seal protector housing bore 27 and the inner diameter of a seal protector sleeve 32 disposed within bore 27 cooperate to define a lower section of passage 31. The lower section of passage 31 communicates with an axial flow passage 33 in bullnose 11, as shown in FIG. 1A. Bullnose flow passage 33 communicates to the exterior of the bullnose, adjacent its lower end 34, through a plurality of ports 35.

Seal protector sleeve 32 is axially movable in bore 27 of the seal protector housing and in the adjacent portion of bullnose flow passage 33. The seal protector sleeve is biased upwardly in housing 28 by a helical bias spring 36 disposed in a recess 37 in bore 27. The spring is engaged between an external shoulder 38 on sleeve 32 and the upper end of bullnose 11 when the bullnose is screwed into the lower end of the underreamer body. The upper limit of travel of the seal protector sleeve, relative to the seal protector housing, is shown in FIG. 1B; FIG. 1B shows that when the seal protector sleeve is at its upper limit of travel in its housing, the upper end 39 of the sleeve is disposed adjacent the upper end of bore 27. An annular seal 40 is carried by the seal protector housing circumferentially of bore 27 closely adjacent to the upper end of the bore for cooperation alternatively with the outer surface of seal protector sleeve 32 or with the outer portion of the lower end of cam sleeve 23, depending upon whether underreamer 10 is disposed in its closed or its opened state. Annular wipers 41 are provided in the seal protector housing and in the upper extent of the bullnose to slidably cooperate with the exterior of seal protector sleeve 32 at all times during the operation of the underreamer.

Cam sleeve 23, as noted above, is axially movable in the underreamer body. It has an upper limit of travel, illustrated in the lower portion of FIG. 1, in which its lower end 25 is spaced above the upper end of seal protector housing bore 27. It has a lower actuated position in the underreamer, as shown above axis 14 in FIG. 1, in which its lower end 25 is engaged within bore 27 to engage and downwardly displace seal protector sleeve 32. In its actuated position, the cam sleeve lower end is disposed below seal 40 which then engages the exterior of the cam sleeve.

As shown best in FIG. 1B, the upper and lower limits of travel of the cam sleeve are above and below the "home" or retracted positions of a plurality of cutter elements 45 which are carried by the lower ends of a plurality of cutter support arms 46, the upper ends 47 of which are engaged with cooperating hinge pins 48. Cutter support arms 46 are movable about their hinge pins into and out of retracted positions, shown in the lower portion of FIG. 1B, wherein the cutter support arms, and the cutters carried thereby, are disposed essentially within the cylinder defined by the outer diameter of underreamer body 13. The cutter support arms also have opened or extended positions in which the lower ends of the arms are displaced outwardly from the underreamer axis sufficiently to provide the desired exposure of cutter elements 45 to the exterior of the underreamer body. The cutter support arms are moved between their retracted and opened positions in response to downward movement of the cam sleeve and in response to the cooperation of a cam ring 49, carried by the exterior of sleeve 23 adjacent its lower end, with a cooperating follower surface 50 defined by each of the cutter support arms.

In underreamer 10 there are three cutter support arms disposed equidistantly from each other around the circumference of the underreamer. The support arm hinge pins 48 are all disposed at a common station along the length of the underreamer. FIG. 1B should not be interpreted as meaning that the two cutter support arms shown there are disposed diametrically opposite each other in the underreamer body. The upper and lower portions of FIG. 1 are mirror images of each other, and differ from each other only to the extent necessary to illustrate the two different basic operative states of the underreamer.

As shown in FIG. 2, cutter support arms 46 are disposed inelongate recesses 51 formed through the underreamer body. The lengths of the recesses are aligned with the length of the underreamer.

In underreamer 10, cutter elements 45 are provided as rotary cutter cones of the type which are encountered in rotary cone drill bits, for example. There are three different cutter cones 52 in underreamer 10, one associated with each cutter support arm. Each cutter cone is disposed to have its heel 53 disposed adjacent the lower end of the support arm. Each cutter cone is rotatably mounted to the support arm by suitable bearings, not shown, so that the cutter cone rotates about its axis of symmetry. Each cone has a nose 54 at its apex.

As illustrated in FIG. 1B, the retracted position of cutter support arms 46 corresponds to the upward position of cam sleeve 23. When the cam sleeve is in its upper unactuated position in the underreamer, its lower end 25 is disposed above the retracted positions of the cutter cones. Accordingly, the cutter cones can be sized so that their noses 54 are disposed essentially along underreamer axis 14 when the cones are retracted into the body. This means that in underreamer 10 larger size cutter cones, of a size heretofore encountered only in rock-type underreamers, are used.

The cutter support arms are driven from their retracted to their open positions by downward movement of cam sleeve 23. As shown in FIG. 1B, cam ring 49 has a cylindrical arm-holding surface 55 and a downwardly-facing, conical, arm-driving ramp surface 56; the half angle of the cone defined by surface 56 is on the order of 45 degrees. Cam follower surface 50 of each cutter support arm 46 is defined in a recess in the inner (toward the axis) side of the arm adjacent its upper end. It is the bottom surface of this recess which defines cam follower surface 50. Adjacent the hinge pin 48 for each arm 46, the cam follower surface has its greatest departure, as at 57, from the underreamer axis. Proceeding downwardly along cam surface 50 away from hinge pin 48, follower surface portion 57 is followed by a short highly-sloped ramp portion 58, and then by a moderately-sloped, relatively long ramp portion 59 of considerable extent along the length of the arm, and then by a second highly-sloped ramp portion 60 which extends to a second moderately-sloped ramp portion 61.

When the cam sleeve is in its upper position and the cutter support arms are in their retracted positions, the outer surface 55 of the cam ring is disposed in the upper portions of the cam follower recess to register with portion 57 of cam follower surfaces 50; at such time, the cam ring ramp surface 56 registers with ramp portions 58 of follower surfaces 50. As soon as the cam sleeve begins to move downwardly in the underreamer body, cam ring ramp surface 56 cooperates with follower surface portions 58 to cause the lower ends of the cutter support arm to move outwardly by an amount which is sufficient to cause the noses of cutter cones 52 to occupy positions more outwardly from underreamer axis 14 than the outer diameter of cam sleeve 23 adjacent its lower end. At this point, follower surface portions 59 are substantially parallel to the underreamer axis, so that continued downward motion of the cam sleeve produces no further outward movement of the lower ends of the cutter support arms until cam ring surface 56 engages highly-sloped follower surface ramp portions 60. Cooperation of cam ring surface 56 with ramp portions 60 causes the cutter support arms to hinge outwardly to its fully extended position during continued downward motion of the cam sleeve. The last increment of motion of the cam sleeve downwardly in the underreamer causes the cylindrical outer arm-holding surface 55 of the cam ring to register with the lower moderately sloped ramp portions 61 of the cam follower surfaces; at this point, ramp portions 61 are disposed parallel to the underreamer axis so that axial motion of the cam ring therealong produces no further outward motion of the lower ends of the cutter support arms.

As shown most clearly in FIG. 1B, the outer diameter of cam sleeve 23, between its lower end and cam ring 49, is essentially the same as the outer diameter of seal protector sleeve 27. Accordingly, the lower end of the cam sleeve, in the last increments of its downward motion, moves into registry with bore 27 in seal protector housing 28. As this occurs, the lower end 25 of the cam sleeve abuts the upper end of seal protector sleeve 32 and pushes it downwardly in its housing against the bias of spring 36. This places the upper and lower portions of underreamer axial fluid flow passage 31 in fluid flow communication with each other. Accordingly, when underreamer 10 is in its opened or actuated condition, it provides an axial fluid flow passage from end-to-end thereof. Thus, when underreamer 10 is in its open position, it has the same attributes as a conventional drilling-type underreamer. In a conventional drilling-type underreamer, however, the cutter elements have to be substantially smaller than the cutter elements provided in underreamer 10; the inner extent of the cutter elements in a conventional drilling-type underreamer can be no closer to the underreamer axis than the outer diameter of that portion of the underreamer structure which defines the fixed circulation fluid flow passage past the retracted positions of the cutter elements.

Underreamer 10, as illustrated in FIG. 1, is arranged for actuation between its closed and open states in response to the pressure of circulation fluid in flow passage 31. Circulation fluid pressure is presented to the upper face 63 of a piston ring 64 which is disposed in a piston recess 65 defined within the piston sub 16 of underreamer body 13 at the upper end of the piston sub. The piston recess defines an annular chamber 6 about the exterior of the cam sleeve intermediate the length of the cam sleeve, but closer to the upper end of the sleeve than to its lower end. The piston ring 64 is secured, as by threads 67, to the exterior of the cam sleeve. The lower end of the annular piston cooperates with the upper end of a piston bias spring 68, which is also disposed in piston chamber 66 and which has its lower end abutted with the lower end of recess 65 adjacent the lower end of piston sub 16.

Circulating fluid in passage 31 above the upper end of cam sleeve 23 is communicated to piston chamber 66 via a plurality of actuator flow passages 70 defined in filter sub 15 at the upper end of the underreamer body. As shown in FIG. 1E, each flow passage 70 has a relatively larger diameter radial portion 71 having a reduced diameter inlet throat 72 from flow passage 31 and a relatively larger diameter section 82 centrally of the walls of the filter sub. A filter element 43 is disposed in each radial portion 71 and is biased by a spring 88 into engagement with the shoulder between passage sections 72 and 82. Spring 88 is disposed within the filter element and cooperates with the inner face of a threaded plug 89 engaged in the outer end of a hole which is machined into the filter sub to define passage portion 71. The presence of threaded closure plug 89 makes it a simple matter to change filter elements 43 in the event that they should become clogged in use. The remainder of each actuator flow passage 70 is defined by a duct 77 which communicates between passage section 82 and piston chamber 66 through a lower face of the filter sub. All fluid entering into a duct 77 from underreamer passage 31 must flow through a respective one of filter elements 43.

To operate the underreamer actuator mechanism, of which cam sleeve 23 is a component, the underreamer is connected at a suitable location in a drill string and lowered into the hole to be underreamed until the underreamer is disposed at the upper end of the portion of the hole to be underreamed. A "go-devil" is dropped down the interior of the drill string to mate with and close the upper end of the hollow cam sleeve. A "go-devil" is a retrievable plug which is commonly used in wire line operations in the petroleum drilling industry. Once the upper end of cam sleeve 23 has been closed by a "go-devil" or the like, the circulation fluid (air or drilling mud) in passage 31 is pressurized sufficiently to cause the pressure-generated force on the upper face 63 of piston 64 to be sufficiently great to overcome the upwardly effective force exerted upon the piston by piston bias spring 68. The piston is driven downwardly relative to the underreamer body by applied fluid pressure until the lower end of the cam sleeve mates with the upper end of seal protector sleeve 32 in the lower portion of the underreamer. In the course of this downward movement of the cam sleeve, the cutter support arms are moved from their closed to their open position as described above.

As shown in FIG. 1D, a plurality of detent plugs 69 are carried in the outer walls of piston 64, preferably adjacent to its upper face. The detent plugs are movable radially of the piston and are biased outwardly toward the walls of piston recess 65 by suitable bias springs. When the cam sleeve is in its lower position within the underreamer body, the detent plugs are aligned with and move outwardly into an annular detent groove 62 machined into the walls of recess 65. Sufficient detent plugs 69 are provided in piston 64 that, when the detent plugs are engaged in detent groove 62, the force which must be applied upwardly to the piston to cause the detent plugs to move inwardly against their bias springs and to release from the detent groove is greater than the force applied upwardly by the compressed piston bias spring. It is therefore apparent that underreamer 10 includes a mechanical hold-open feature; it is not held open by differential fluid pressure forces as is the case with underreamer 90 shown in FIG. 3, for example.

Once the cam sleeve has been fully moved downward and detented in the underreamer, the circulation fluid pressure applied to cause such downward movement can be relaxed. The "go-devil" is then removed from the drill string, using conventional wire line fishing techniques. Once the "go-devil" has been removed from the upper end of the cam sleeve, drilling fluid can be circulated through the entire length of the underreamer, and through the exit ports 35 provided for this purpose in the underreamer as the underreamer is driven about its axis in response to rotation of the drill string of which it is a component. Such rotation of the underreamer about its axis causes cutter elements 45 to remove the geological formation below the cutter elements as the drill string is lowered and underreaming occurs.

Once the borehole has been underreamed to the desired extent by use of underreamer 10, it normally is desired to remove the underreamer from the borehole. In order for this to ossur, it is necessary to operate the underreamer from its opened to its closed position. In underreamer 10, closure of the underreamer is accomplished mechanically by raising the drill string until the extended arms of the underreamer engage the restriction in the bore hole below which underreaming occurred, and by then pulling upwardly on the underreamer for a short distance. In this connecton, particularly as shown in FIGS. 1B and 1C, cutter support arms 46 define upwardly open notches 73 in their exteriors adjacent their upper ends. The notches terminate in upwardly facing shoulders 74 (see also FIG. 2). Shoulders 74 engage the borehole restriction as the opened underreamer is raised in the borehole.

The cutter support arms are coupled by their hinge pins 48 to a sleeve-like elongate arm hinge ring 75 which is interposed in the underreamer between cam sleeve 23 and arm sub 17. The several hinge pins are engaged in corresponding outwardly-extending lugs 76 defined in the exterior of the arm hinge ring adjacent its lower end; the lugs are disposed in the upper ends of the corresponding arm recesses 51 and the upper ends of arms 46 are bifurcated to cooperate between the opposite lateral faces of each lug 76 and the adjacent walls of arm recess 51, as shown in FIG. 2. The several lugs 76 thus cooperate with the upper ends of recesses 51 to define a stop which limits upward movement of the arm hinge ring relative to underreamer body 13. The arm hinge ring is biased upwardly relative to the underreamer body by a spring assembly 78 (see FIG. 1C) which is disposed in an annular chamber provided between the upper portion of the body arm sub 17 and the upper extent of the arm hinge ring at the upper end of the body arm sub. Spring assembly 78 preferably is comprised of a plurality of Belleville springs 79, or other suitable spring elements, which are disposed in chamber 78 between the lower end of the chamber and the lower face 80 of a spring retainer ring 81 which is secured, as by threads, to the upper end of the arm hinge ring. In FIG. 1C, the normal position of arm hinge ring axially relative to the underreamer body is illustrated. In this condition, the upper faces of lugs 76 abut the upper ends of arm recesses 51, as shown in FIG. 1B.

Once shoulders 74 on the extended cutter support arms engage the borehole restriction as the opened underreamer is raised in the borehole, the arms are held secure from further upward movement as the drill string is further raised in the borehole. This in turn produces downward movement of the arm hinge ring, relative to the underreamer body and relative to the cam sleeve, against the bias of spring assembly 78. As downward movement of the arm hinge ring relative to the underreamer body and the cam sleeve occurs, cam follower surfaces 50 on the several cutter support arms slide downwardly along the circumferential surface 55 of cam ring 49 until highly sloped ramp portions 60 of cam follower surfaces 50 engage the downwardly facing ramp portion 56 of the cam ring. When this occurs, the force of engagement between sloped surfaces 56 and 60, as a result of the compression of spring assembly 78, has a component upwardly parallel to underreamer axis 14 which is greater than the force required to drive piston detent plugs 69 radially inwardly and out of engagement with detent groove 62. As soon as this hpapens, the force stored in piston bias spring 68 becomes effective to drive piston 64 and cam sleeve 23 upwardly relative to the underreamer body and to the arm hinge ring, thus raising the cam sleeve in the underreamer to its upper limit of travel. As this occurs, the cam ring 49 is no longer effective to hold the cutter support arms in their extended positions, and the arms are then able to swing by gravity about hinge pins 48 into their fully retracted positions. Movement of the cutter elements into their retracted positions occurs as the lower end of the cam sleeve moves to its uppermost position in the underreamer, as shown in the lower portion of FIG. 1B. As this point, the underreamer is returned to its nominal size, defined by the outer diameter of body 13, and the underreamer can then be raised in the borehole past the restriction.

The outer limit of travel of each cutter support arm 46 about its hinge pin 48 is defined by the cooperation provided between a stop plate 83, associated with each arm, and a stop projection 84, defined by each arm. As shown in FIG. 1B and FIG. 2, a stop plate 83 is held against one side wall of each arm recess 51 by a pair of pins 85. The stop plate has a stop finger 86 which extends downwardly along the recess wall adjacent the exterior of body 13. The adjacent side wall of the corresponding arm 46 defines a stop projection 84 near the inner surface of the arm. In way of the stop plate, the adjacent side wall of the cutter support arm is recessed, as at 87 as shown in FIGS. 1B and 2. As the arm swings outwardly in response to downward movement of the cam sleeve, the outer face of stop projection 84 moves into engagement with the radially inwardly facing face of stop finger 86, thereby to preclude further outward movement of the cutter support arm about its hinge pin.

If it is desired to alter the expanded size of a particular underreamer 10, all that is necessary is that stop plates 83 be replaced by stop plates having different stop finger configurations so that stop projections 84 engage the radially inner faces of the stop plate fingers closer to or farther from the underreamer axis. Also, the cutter support arms are replaced by other arms having correspondingly different cam follower surface configurations.

Underreamer 10 is arranged to be operated from its closed to its opened state by the application of fluid pressure after to flow passage 31 after temporary engagement of a "go-devil" or other removable plug with the upper end of the cam sleeve. Underreamer 10 is held open mechanically by the cooperation between detent plugs 69 and detent groove 62. The underreamer is operated from its opened to its closed position by mechanical processes involving shoulders 74, arm hinge ring 75, and arm hinge ring bias spring assembly 78.

Underreamer 10 can be used by itself in a drill string or in combination with a rotary drill bit connected to the lower end of the underreamer either directly or indirectly via other components of a suitable drill string. It is not possible, however, to use two identical underreamers 10 in serial arrangement in a drill string because of the need to use a "go-devil" to close the upper end of the cam sleeve so that circulating fluid pressure can be applied to piston 64. However, if two underreamers 10 generally identical to each other except for the inner diameters of their cam sleeves 23 are provided, then two underreamers 10 can be used in serial arrangement in a drill string if the underreamer having the smaller inner diameter cam sleeve is used as the lower one of the two underreamers. In this situation two different sizes of "go-devils" would be required, a relatively larger diameter one for use first in actuating the upper underreamer and then a relatively smaller diameter one (sized to pass through the flow passage in the upper underreamer but to seat on the upper end of the cam sleeve in the lower underreamer) for actuating the lower underreamer.

Figures 3A, 3B:
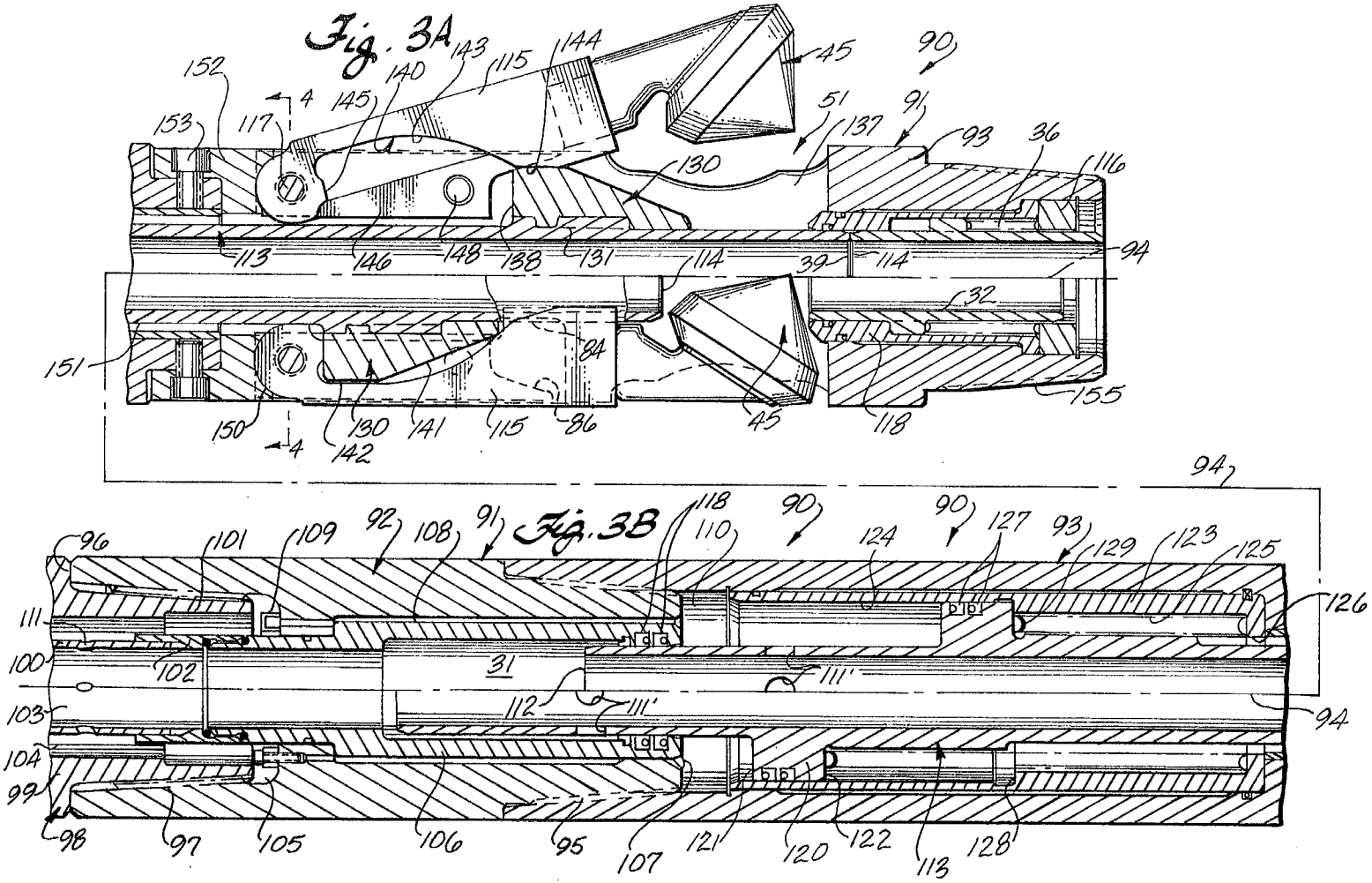
FIG. 3A and FIG. 3B, is a cross-sectional elevational view of the presently preferred underreamer showing the underreamer in its opened and closed states, above and below the underreamer center line.
Figure 4:
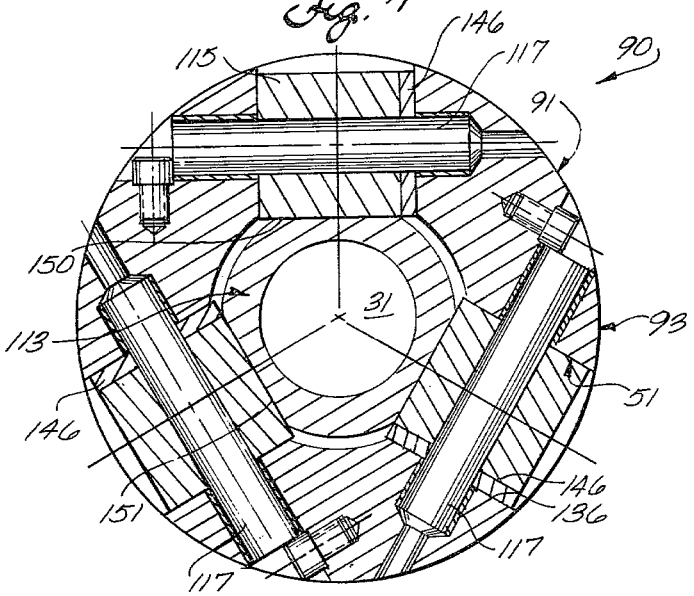
FIG. 4 is a cross-section view taken along line 4—4 in FIG. 3.
Figure 6:
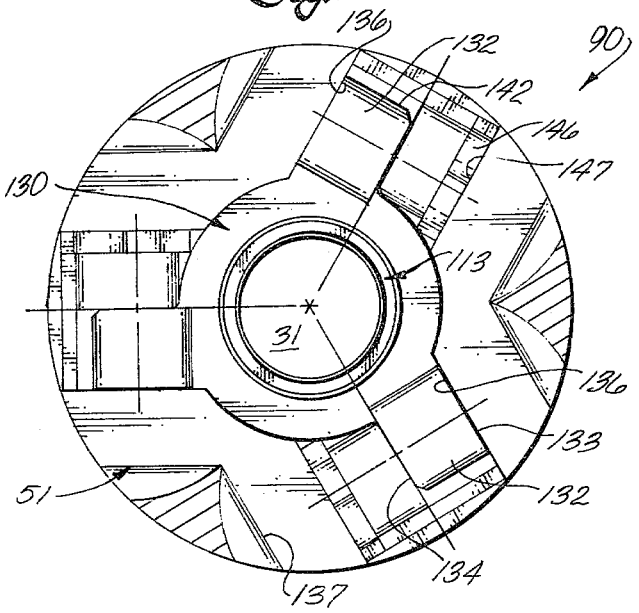
FIG. 6 is a cross-section view taken along line 6—6 in FIG. 5.
Figure 5:
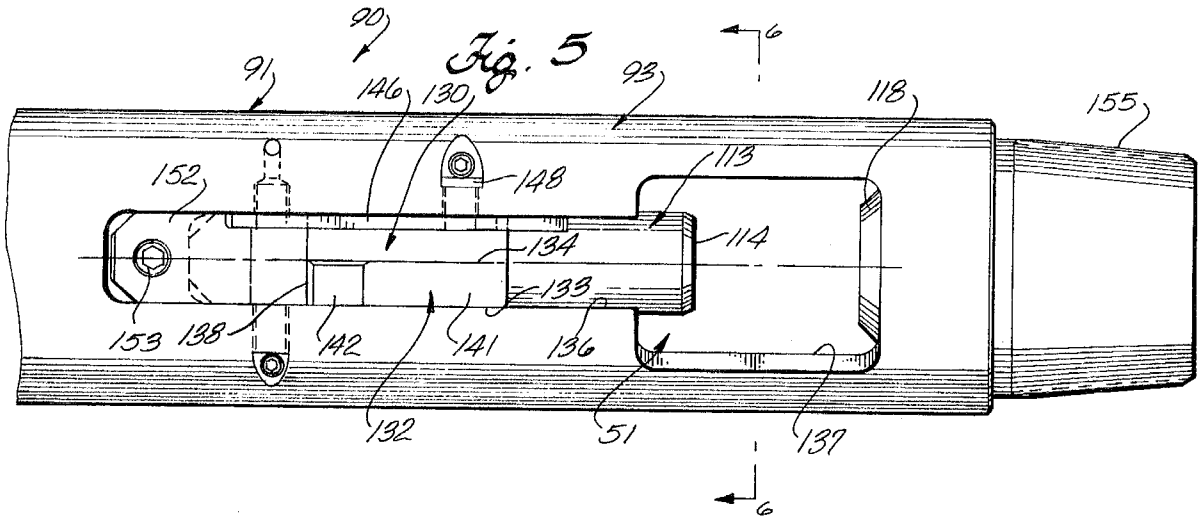
FIG. 5 is a fragmentary elevation view of the portion of the underreamer shown in FIG. 3A.

FIGS. 3A and 3B (which collectively constitute FIG. 3), and FIGS. 4, 5 and 6 show another underreamer 90 according to this invention. Underreamer 90 is the presently preferred rmbodiment of this invention. It is preferred over underreamer 10 because underreamer 90 is usable in connection with both conventional and reverse circulation drilling procedures, because it is more readily alterable to change its effective size when opened, and because it used circulating fluid pressures to open, hold open and close the underreamer. It is also somewhat more simple in structure than underreamer 10.

In the following description of underreamer 90, certain of the character numbers used in the description of underreamer 10 are used where the components of the two underreamers are the same or differ from each other only in minor respects not material to the inventive aspects of underreamer 90.

As shown best in FIGS. 3A and 3B, underreamer 90 has an elongate, hollow tubular body 90 which is composed of a tubular reverse circulation cross-over sub 92 at the upper end of the body, and a piston and arm sub 93 defining the major lower part of the body. Piston and arm sub 93 combines the functions of piston sub 16 and arm sub 17 of underreamer 10. Subs 92 and 93 have equal outer diameters and are threaded together coaxially of underreamer axis 94 at their lower and upper ends, respectively, by a thread 95. The upper end 96 of cross-over sub 92 is internally threaded to define a box component of a pin and box threaded connection 97 which adapts the underreamer to be connected to a cooperating pin component of the connection defined at the lower end of a string of double-wall reverse circulation drill pipe 98. Reverse circulation drill pipe 98 is of a commercially available type and includes an outer, heavy-walled torque transmitting pipe 99 at the lower end of which the pin component of connection 97 is defined. Pipe 98 also includes a smaller diameter coaxially disposed thin-walled inner tube 100 which is held relative to the outer pipe by spacer lugs which extend radially inwardly from the outer pipe. The spacer lugs cooperate with a sealing sleeve 102 which is carried by the lower end of inner tube 100. The outer diameter of tube 100 is less than the inner diameter of outer pipe 99 so that reverse circulation drill pipe 98 defines therein a central axial fluid flow passage 103 along the interior of tube 100 and an outer annular fluid flow passage 104 between tube 100 and pipe 99. Sealing sleeve 102 is adapted to cooerate with the adjacent ends of tubes 100 in adjacent lengths of drill pipe 90 in a drill string composed of plural lengths of such pipe. Accordingly fluid present in annular flow passage 104 is communicated from length to length of the drill pipe and, as shown in FIG. 3, to an annular chamber 105 defined in cross-over sub 92 adjacent to the base of the internal threads defined by it at its upper end.

Chamber 105 is provided circumferentially of a tubular seal and piston support sleeve 106 which is secured within the cross over-sub body, as by weldments 107. A plurality of fluid flow passages 108, one of which is shown in FIG. 3B are provided in the cross-over sub between chamber 105 and the opposite end of the sub. These passages extend generally parallel to the axis of the sub at selected locations angularly about the sub axis. Each passage 108 has an inlet end to chamber 105. The inlet end of each flow passage is fitted with a suitable filter 109 to prevent the entry of particulate matter into the passage. The other ends of passages 108 connect to a piston chamber 110 which is defined at the upper end of piston and arm sub 93.

Double wall drill pipe 98 as shown in FIG. 3B may be a component of a Duo-Tube Airlift Drilling System, such as is marketed by Drilco Industrial Division of Smith International, Inc. Where such double wall drill pipe is used, a plurality of apertures 111 are formed through inner tube 100 adjacent the lower end of the tube in the lowermost length of such drill string to provide communication between inner and outer flow passages 103 and 104 respectively. Alternatively, these apertures can be located through cam sleeve 113 at a position above piston 120 which is selected so that the apertures, such as apertures 111' shown in FIG. 3B, are disposed above seals 119 when the underreamer is in its closed state; with this arrangement, apertures 111' enable reverse circulation to be initiated by air applied to passage 104 after the underreamer has opened, but upon closure of the underreamer the apertures are above seals 119 and are thus closed from passage 104, so that passage 104 does not fill with drilling mud when the underreamer is closed. Thus, air pressure applied to passage 104 need not force drilling mud from the passage before reverse circulation can be initiated.

The bore of piston support sleeve 106 defines an upper portion of an underreamer axial flow passage 31. Piston support sleeve 106 has a relatively smaller diameter bore section at its extreme upper end corresponding to the inner diameter of tube 100 of the double wall drill pipe, and it has a relatively larger diameter bore portion at its lower end within which cooperates the upper end of an elongate open-ended hollow tubular cam sleeve 113.

The cam sleeve 113 has a lower end 114 which, in the closed state of the underreamer, is disposed above the nested, "home", or stored position of a plurality of cutter elements 45 carried on the lower ends of a corresponding plurality of cutter support arms 115, the upper ends of which are pivotally connected to the body of piston and arm sub 93 by hinge pins 117 (see FIG. 3). When the cam sleeve is in its lower actuated position, corresponding to the open or expanded state of the underreamer, the lower end 114 of the cam sleeve is disposed below the "home" positions of cutter elements 45 and cooperates with the upper end 39 of a seal protector sleeve 32 disposed coaxially in the lower end of the piston and arm sub 93. The inner and outer diameters of the lower end of the cam sleeve 113 and of seal protector sleeve 32 are equal.

The seal protector sleeve is biased upwardly in the underreamer by bias spring 36 which is disposed circumferentially of the sleeve and which is engaged at its upper end with a circumferential collar formed on the exterior of the sleeve and at its lower end with a spring retainer ring 116 held in position in the lower end of the sub by a suitable split reatiner ring. The bias spring 36 and the collar of sleeve 32 are disposed in a large diameter portion of a bore in a holder sleeve 118, the upper end of which has an inner diameter cooperating closely with the outer diameters of sleeve 32 and cam sleeve 113. When the underreamer is in its closed condition and the cam sleeve is at its upper limit of travel in the underreamer body, seal protector sleeve 32 has its upper end substantially registered with the upper end of sleeve 118. However, when the cam sleeve is at its lower limit of travel in the underreamer, its lower end is engaged in the upper end of sleeve 118, thereby to provide communication between the upper and lower portions of underreamer axial flow passage 31.

A piston 120 is defined integrally with cam sleeve 113 adjacent its upper end 112 and circumferentially about its exterior. The piston has upper and lower faces 121 and 122, the upper face effectively defining the lower end of piston chamber 110. The piston reciprocates in a piston cylinder sleeve 123 which has a relatively larger diameter bore 124 axially thereof at its upper end, a relatively intermediate diameter bore 125 in its lower portion, and a relatively smaller diameter bore 126 at its extreme lower end. Bore 124 has a diameter corresponding to the diameter of piston 120. The piston is effectively sealed to bore 124 by suitable seals 127. The cylinder sleeve is held axially in position in the underreamer body against an upwardly facing shoulder with which the lower end of the cylinder sleeve is engaged, and by a suitable retainer ring which cooperates with the upper end of the sleeve.

An upwardly facing shoulder 128 is defined by sleeve 123 between bores 124 and 125. Engagement of piston lower face 122 with shoulder 128 defines a stop which limits downward movement of cam sleeve 113 in the underreamer. The cam sleeve is biased upwardly in the underreamer by a piston bias spring 129 which is engaged between the piston lower face and the upwardly facing shoulder defined by the cylinder sleeve between bores 125 and 126.

A cam ring 130 is carried by the exterior of cam sleeve 113 adjacent its lower end. The cam sleeve is shown in longitudinal cross section and in elevation in FIGS. 3A and 6, respectively. The cam ring is removably secured to the cam sleeve by a bayonet coupling. As shown best in FIG. 6, the cam ring defines three outwardly extending cam lobes 132 at equidistantly spaced locations about its circumference. There is one cam lobe provided for each of the three cutter support arms 115 in underreamer 90. The cam lobes do not extend truly radially from the axis of the cam ring, but extend parallel to a radius of the cam ring. Each cam lobe has a left side face 133 and a right side face 134, as shown in FIG. 6, the right side face being disposed in a plane radially of the cam ring. The distance between the left and right side faces of each cam lobe is approximately one-half the width of the upper portion 136 of the corresponding support arm recess 51 within which the corresponding arm is disposed in the closed position of the underreamer. (The width of the recess is the dimension of the recess about the circumference of the underreamer body.) As shown in FIG. 5, each arm support recess has a relatively narrow upper portion 136, within which the upper and major portion of the length of the arm is disposed, and a larger lower portion 137 within which cutter element 45 is disposed when the underreamer is closed. The left side face 133 of each cam lobe substantially abuts the left side wall of the upper portion of the corresponding support arm recess.

Each cam lobe has an upper end face 138 which is perpendicular to the axis of the underreamer and which is coplaner with the upper end of the cam ring.

The left portion of the inner face of each cutter support arm 115, immediately adjacent to the upper portion of the arm where it journals hinge pin 117, is recessed to define a cam follower surface 140; the inner face of the cam support arm is that face of the arm which is disposed toward the center line of the underreamer when the underreamer is closed. Each cam follower surface 140 is configured to cooperate with a relatively moderately sloped arm-driving ramp surface 141 on the adjacent cam ring lobe. Each ramp surface 141 faces downwardly and outwardly of the underreamer; at its upper end, it connects to an arm-holding surface 142 which is disposed parallel to the underreamer axis. Each cam follower surface has its greatest spacing from the underreamer axis at its upper end, from which location it curves gradually through a driving portion 143 to a holding surface portion 144 which is defined to be parallel to the axis of the underreamer when the arm is in its fully opened position.

A stop surface 145 is defined in each arm adjacent the corresponding hinge pin in association with the corresponding cam follower surface. Each stop surface 145 faces along the length of the cutter support arm and is disposed perpendicular to the underreamer axis when the cutter support arm is retracted. Each stop surface 145 cooperates with upper end surface 138 of the corresponding cam ring lobe to define the upper limit of travel of cam sleeve 113 in the underreamer when the underreamer is closed. Such cooperation also holds the cutter support arms from swinging outwardly from their retracted positions when the underreamer is closed. This action is accomplished by the upward force applied to the cam sleeve by the piston bias spring.

A stop plate 146 is located in each cutter support arm recess and is positioned against the right wall 147 of the recess (see FIG. 6 at the one o'clock position, for example). The stop plate is drilled at its upper end to journal the adjacent arm hinge pin 117 and is tapped adjacent its lower end for threaded cooperation with a holding bolt 148 in the manner shown in FIG. 5. The stop plate is thus held secure against the side wall of the upper portion 136 of the support arm recess and held secure from motion relative to that wall. The stop plate defines a stop finger 86 in the manner described above. The stop finger cooperates with a stop projection 84 defined by the adjacent side of the corresponding support arm in the manner described above concerning underreamer 10. The cutter support arm is thus limited in the extent to which it can pivot outwardly from the underreamer axis about its hinge pin in response to cooperation between the cam lobe surfaces and the respective portions of cam follower surface 140.

The upper end surface 150 of each cutter support arm is defined as a portion of the right circular cylinder disposed concentric to the axis of the corresponding hinge pin. This surface cooperates with a respective flat surface 151 formed in the exterior of cam sleeve 113. The radius of curvature of surface 150 is essentially equal to the distance from surface 151 to the axis of the corresponding arm hinge pin. Accordingly each support arm end surface 150 and the corresponding flat surface 151 function as key and keyway, respectively, to prevent rotation of cam sleeve 113 about underreamer axis 94 once the underreamer has been fully assembled. The prevention of rotation of the cam sleeve about the underreamer axis is desired because the cooperation between cam ring 130 and the several cutter support arms is via individual cam lobes 132 which are formed only locally of the circumference of the cam ring, rather than entirely about the circumference of the cam ring as is the case with cam ring 49 in underreamer 10. The cooperation between surfaces 150 and 151 to secure the cam sleeve from rotation about the underreamer axis is illustrated best in FIG. 4.

A closure and support arm bearing plug 152 is fitted into the upper end of the upper part 136 of each arm support recess 51 of underreamer 90 between the upper end surface 150 of the adjacent support arm and the adjacent upper end wall of the recess. Each plug is held in position in the underreamer body by a bolt 153 which is threaded into piston and arm sub 93 as shown in FIG. 3A. The lower end surface of each plug 152 is arcuately curved to cooperate closely with a support arm end surface. In this way the forces applied upwardly along the extent of each cutter support arm as the underreamer is operated in its open condition are transferred via plugs 152 to the underreamer body rather than being borne entirely by hinge pins 117. In view of this arrangement the hinge pins function principally as fulcrums affording pivotal movement of the cutter support arms relative to the underreamer body.

The extreme lower end of the underreamer body is externally threaded as at 155 to define the pin portion of a conventional pin and box threaded connection of the type which is typically encountered in equipment used in the drilling of oil and gas wells. The lower end of the underreamer is thereby adapted to be connected to another underreamer 90, to a rotary cone drill bit, or to any other desired component of a drill string.

Underreamer 90 is opened, held open, and closed by differential forces derived from the pressures encountered in piston chamber 110, on the one hand, and fluid pressures otherwise applied to the underreamer structure, on the other hand. As described above, underreamer 90, by virtue of the provision therewith of reverse circulation cross-over sub 92, is arranged to be used with a double wall drill pipe in drilling processes involving reverse circulation of fluid through underreamer flow passage 31. Assume that the underreamer has been connected at the desired location in a drill string composed principally of double wall drill type 98 and is being lowered into the borehole to the position where underreaming is to be performed. Typically the borehole will be filled with liquid circulating fluid or drilling mud. As the underreamer is lowered into the borehole, this drilling mud will enter into the interior of the underreamer to fill flow passage 31 and axial flow passage 103 in the double wall drill pipe. In order that reverse circulation can be initiated, air is applied under pressure to outer annular flow passage 104 in the double wall drill pipe. The pressure of the air applied at this point must be relatively high in order to cause the drilling mud in passage 104 (which will have entered the passage through apertures 111 at the lower end of the double wall drill pipe) to be forced out of that passage through apertures 111. That is, to initiate reverse circulation of drilling mud upwardly through the central flow passage of the double wall drill pipe, air must be applied to the outer passage in the drill string at a pressure which is greater than the air pressure required to maintain reverse circulation once the airlift effect has been initiated in the central flow passage of the drill pipe. This increased pressure of the fluid in drill pipe passage 104 is communicated to piston chamber 110 via filters 109 and actuator flow passages 108 in the reverse circulation cross-over sub. This pressure may be transmitted to the piston chamber by drilling mud or by air, but usually by air for reverse circulation.

The pressure which is generated in the outer flow passage of the double wall drill pipe to initiate reverse circulation of circulating fluid up through the drill pipe is sufficiently great, in combination with the effective area of piston upper face 121, as compared to the pressure of drilling mud applied to other portions of the cam sleeve, to create a differential force acting downwardly on the cam sleeve. This differential force is greater than the force required to deflect piston bias spring 129 by an amount equal to the desired downward travel of the cam sleeve. Accordingly, the pressures applied to initiate reverse circulation are also effective to operate the underreamer from its closed to its opened state.

Once the underreamer has been operated to its opened state, the lower end of the cam sleeve is abutted with the upper end of seal protector sleeve 32. When such abutment occurs, the effective area to which fluid pressure outside the underreamer can be applied is reduced. Thus, the pressure-oriented forces acting upon the cam sleeve to drive it upwardly in the underreamer are reduced. This reduction is more than the effective reduction in force applied to the upper face of the underreamer piston once reverse circulation is actually initiated in the drill pipe above the underreamer. For this reason, the underreamer is held open by a downwardly effective differential force derived from fluid pressures applied to the cam sleeve as underreaming occurs, regardless of the nature of the equipment present in the drill string below the underreamer.

Once underreaming has been completed over the desired length of the borehole of interest, all that is necessary to cause the underreamer to be operated from its opened to its closed state is to significantly decrease the pressure of air applied to the outer flow passage in the double wall drill pipe. In other words, once underreaming has been completed, reverse circulation of drilling fluid up through the double wall drill pipe is terminated. Reverse circulation is effectively terminated by venting the outer flow passage of the drill pipe to atmosphere. The differential forces applied to the cam sleeve, in cooperation with the constant upward bias applied to the underreamer piston by spring 129, are then effective to drive the cam sleeve to its upper limit of travel within the underreamer. As this occurs the underreamer cutter support arms swing, under the influence of gravity, inwardly toward the axis of the underreamer to their "home" positions where they are held by cooperation between cam lobe upper surfaces 138 with stop surfaces 145. As the underreamer piston 120 moves upwardly in the piston chamber, fluid present in the chamber is expressed therefrom through passages 108. Reverse flow of fluid through filter element 109 tends to clean the filters of any particulate matter which may have accumulated thereon as the underreamer was opened or during its operation in its opened state.

Cam ring 130 is inserted into piston and arm sub 93 before the cam sleeve is inserted into the sub and before cutter support arms 115 are connected to the sub. The cam ring is inserted into position coaxially of the sub through support arm recesses 51. That this is possible will become apparent from an inspection of FIG. 6. The cam ring is then moved into the upper portions of recesses 51 and into the position which it is to occupy in the retracted position of the cam sleeve. The cam sleeve and piston assembly are then inserted into the upper end of sub 93, and the lower end of the cam sleeve is stabbed axially through the cam ring. The cam ring is then held in its intended position angularly relative to the sub; this is done by wedging a stop block, wrench or the like into the space between one of cam ring lobes 132 and the right surface of the corresponding arm recess upper part 136. The cam sleeve is then indexed angularly relative to the cam ring about the underreamer axis to engage the bayonet connection of the cam ring to the cam sleeve. This turning of the cam sleeve relative to the underreamer body brings into registry with the arm recess upper portions 136 the several flat surfaces 151 machined into the exterior of the cam sleeve above the installed position of the cam ring. Stop plates 146, arms 115, arm hinge pins 117, and bearing plugs 152 are then installed in the appropriate order.

The nature of the bayonet coupling of the cam ring 130 to cam sleeve 113 is defined with respect to the usual direction of rotation of the underreamer in use. The forces applied to the cam ring by the cutter support arms are effective to drive the cam ring into, rather than out of, its bayonetted connection to the cam sleeve.

The bayonetted connection of the cam ring to the cam sleeve in underreamer 90 greatly facilitates the adjustment or modification of the underreamer to vary its effective size when opened. Such alteration of the effective expanded size of the underreamer is accomplished merely by changing the cam ring and stop plates for other elements of like type but different geometry arranged to drive the cutter support arms to different opened positions in response to downward movement of the cam sleeve in the underreamer.

It will be noted that arm-driving ramps 141 of cam ring lobes 132 in underreamer 90 are sloped substantially less relative to the underreamer axis than is the case of arm-driving surface 56 on cam ring 49 in underreamer 10. This can be the case because the axial components of the forces applied by the cutter support arms to ramps 141 are not relied upon to drive the cam sleeve upwardly in underreamer 10 as it is operated from its opened to its closed state.

When underreamer 90 is equipped with a reverse circulation cross-over sub at its upper end, as shown in FIG. 3, it is useful only with reverse circulation drilling processes. Also, when reverse circulation drilling processes are practiced only a single underreamer 90 can be used in the drill string. It is a simple matter to adapt underreamer 90 for use with conventional circulation processes simply by replacing reverse circulation cross-over sub 92 by a sub which provides communication of piston chamber 110 to the upper portion of underreamer flow passage 31. Such a sub would be very similar to filter sub 15 described above in connection with underreamer 10. For conventional circulation processes to be used in connection with underreamer 90, the only additional change which must be made to the structure of the underreamer, as described above, is the provision of some mechanism to generate sufficient pressure-related downwardly-acting force differential on the cam sleeve to cause the cam sleeve to be driven from its upper to its lower limit of travel in the underreamer. Once the underreamer has been operated to its opened state, sufficient downwardly-acting pressure-related forces will be applied to the cam sleeve to maintain the underreamer in its opened state during the continuance of conventional circulation through the underreamer.

One effective way of providing the appropriate force differential, sufficient to cause the underreamer to open in response to fluid pressures encountered in conventional circulation, is to equip the underreamer with a FLO-TEL pin. A FLO-TEL pin is a pin which would be held by suitable spider arms along the axis of the underreamer cam sleeve in fixed relation to the underreamer body, or to the body of a sub connected to the underreamer in place of sub 92, to extend into the upper end of the cam sleeve along the portion of axis 94 which is traversed by the upper end of the cam sleeve in moving from its upper limit of travel to that point in its motion where its lower end first engages the upper end 39 of seal protector sleeve 32. This arrangement will generate sufficient downwardly effective differential force on the cam sleeve to cause it to be operated from its upper to its lower positions in the underreamer. Downward motion of the cam sleeve in the underreamer body after engagement of the lower end of the cam sleeve with the seal protector sleeve will continue because, once such engagement has occurred, the downwardly acting differential forces on the cam sleeve, due to circulation fluid pressures, will be great enough to continue to drive the cam sleeve downwardly in the underreamer even after the upper end of the cam sleeve has passed the lower end of the FLO-TEL pin.

Figure 7:
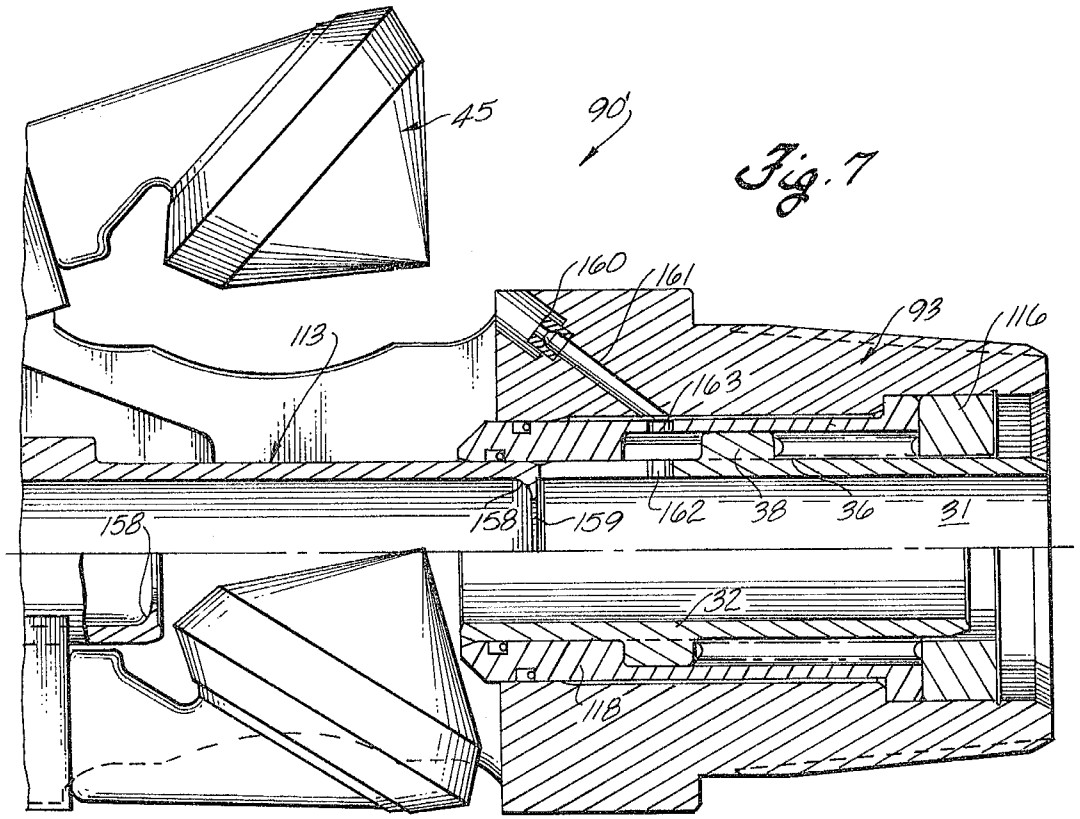
FIG. 7 is a fragmentary elevation view of the lower portion of another underreamer.

Another arrangement for adapting underreamer 90 for use with conventional circulation processes is shown in FIG. 7 which illustrates underreamer 90'. Underreamer 90' is essentially identical to underreamer 90 except for the provision of a lip 158 circumferentially about the interior of the cam sleeve so as to create an orifice 159. The orifice is sized to generate the desired downwardly-acting pressure-related force differential on the cam sleeve to cause it to be driven from its upper to its lower positions in the underreamer body in response to fluid pressures applied to the cam sleeve from within the underreamer and from without. Lip 158 may be provided at any location desired along the length of the cam sleeve. The location of this lip at the lower end of the cam sleeve is shown in FIG. 7 for the purposes of example, the same being a convenient location for this feature.

FIG. 7 also shows another modification of underreamer 90 (or of underreamer 10, if desired) which may be practiced in conjunction with conventional circulation of drilling mud or the like through the underreamer. This modification involves the provision of a fluid wash nozzle 160 in the underreamer body in association with each of cutter elements 45. The nozzles are directed upwardly to discharge circulation fluid from the underreamer toward the cutter elements to clean the elements of cuttings generated during operation of the underreamer. Circulation fluid, e.g. drilling mud, is supplied to each nozzle through a corresponding passage 161 in sub 93. Each passage communicates to the drilling mud flowing through the underreamer axial flow passage 31. Suitable flow apertures 162 are formed through the seal protector sleeve 32 above its external shoulder 38. Also, flow apertures 163 are formed through sleeve 118 into the chamber provided in that sleeve above the shoulder of sleeve 32 when the latter sleeve is displaced by the cam sleeve. In this way, passages 161 are placed in flow connection to the flow passage of the underreamer when the underreamer is opened.

When underreamer 90 is fitted with a conventional circulation sub akin to filter sub 15 illustrated in FIG. 1, the underreamer can be used in a multi-stage configuration, i.e. by an arrangement in which two or more underreamers are stacked in the drill string. It will be observed that underreamer 90 includes three cutter support arms and related cutter elements. Heretofore multi-staging of underreamers in a drill string was possible only with underreamers having only two cutter support arms. This was the case because, prior to the development of the present underreamer which provides an axial flow path through it in the opened state of the underreamer, the only way to obtain a circulation flow path through the length of the underreamer was to use a parallel-flow by-pass arrangement of the type illustrated in U.S. Pat. No. 3,817,339, especially FIG. 5 thereof. The requirements of this parallel flow by-pass arrangement precluded the use of three cutter elements in the underreamer. Thus, the present invention makes possible the multi-staging of three-arm underreamers in a drill string in connection with conventional circulation of drilling mud. With underreamer 90, two three-arm tools can be multi-staged in a drill string because the open and hold-open operations in the underreamer are accomplished entirely in response to the pressure of fluid circulated through the underreamer along its axial flow passage. Thus, if underreamers 90 are multi-staged in a conventional drill string, the underreamers will open proceeding from the top downwardly along the drill string in response to the pressure of circulating fluid presented to the underreamers.

Underreamer 10, as illustrated, can be used in association with conventional circulation techniques or with reverse circulation techniques; it was originally designed for use with reverse circulation. When it is used with reverse circulation, it is connected to a double wall drill pipe, such as drill pipe 98 shown in FIG. 3B, in which the air for initiating and maintaining reverse circulation is injected into the central flow passage of the drill pipe from the outer flow passage of the pipe at a location just above the lower end of the string of drill pipe as connected to the underreamer. Such multi-mode usage (conventional circulation or reverse circulation) of underreamer 10, and also of underreamer 90, is made possible by the extension of the cam sleeve upwardly above the location of the cam sleeve piston into slidably sealed engagement of the cam sleeve with the underreamer body above the underreamer piston chamber. This cam sleeve extension is required for purposes of reverse circulation, but its presence does not prevent the underreamer from being used with conventional circulation.

It is a feature of underreamers of this invention, particularly underreamer 90 wherein cam ring 130 is connected to cam sleeve 131 by a bayonet coupling, that a basic underreamer design can be used to provide a wide range of effective underreaming diameters. Changing the effective diameter of the underreamer requires only that the cam sleeve (in the case of underreamer 10) or the cam ring (in the case of underreamer 90) and the stop plates, in either case, be changed. At this time the only other underreamer which is available and which affords adjustment of its effective size is an underreamer which uses a toggle linkage between the underreamer actuator piston and the cutter support arms. That linkage, however, is so arranged that it is difficult to interchange, and it results in a cutter support arm of reduced strength. It is a feature of underreamers according to this invention that the cutter support arms are very strong.

Workers skilled in the art to which this invention pertains will appreciate that the preceding description of some embodiments of this invention, including the presently preferred embodiment, has been set forth by way of example rather than as an exhaustive catalog of all forms which this invention may take. The preceding description has been set forth in compliance with prevailing practice and statutory requirements. The presently known best mode for practicing this invention is reflected by the structure of underreamer 90. Modifications, alterations and variations in the structures and arrangements described above may be practiced without departing from the scope of this invention. Accordingly, the foregoing description should not be considered as limiting the scope of this invention.

What is claimed is:

1. A borehole underreamer comprising a tubular body adapted at an upper end thereof for coaxial connection to a rotary drill string, a plurality of cutter means support arms having upper and lower ends, the arms being disposed at selected locations around the circumference of the body at a selected point therealong and being mounted at their upper ends for pivotal motion relative to the body between (a) retracted positions in which the arms are disposed essentially within the outer diameter of the body and (b) opened positions in which the arm lower ends are disposed a selected distance outwardly of the exterior of the body, cutter means mounted to the lower end of each arm and configured to extend essentially to the center of the body when the arm is in its retracted position, actuator means in the body selectively operable for moving the arms from their retracted to their opened positions, the actuator means including an open ended tubular element movable downwardly in the body coaxially thereof during operation of the actuator means from (a) an upper position wherein the lower end of the element is disposed above the locations occupied by the cutter means in the retracted positions of the arms to (b) a lower position wherein the lower end of the element is disposed below said cutter means locations, the body having a fluid flow passage therealong comprised of upper and lower axial passage sections respectively above and below said cutter means retracted positions, the lower passage section including means engageable with the lower end of the tubular element in the lower position of the element for connecting the passage upper and lower sections in fluid flow relation via the tubular element.

2. An underreamer according to claim 1 including means carried by the tubular element responsive to fluid pressure communicated via a drill string greater than fluid pressure externally of the body for moving the tubular element in the body from its upper position to its lower position, and wherein the tubular element and the body are cooperatively arranged so that the force differential acting downwardly on the tubular element due to differences in fluid pressure within and without the body, during application of fluid pressure to the actuator means via a drill string, is greater when the element is at its lower position in the body than when the element is at its upper position in the body.

3. An underreamer according to claim 1 including annular piston means carried circumferentially of the exterior of the tubular element and movable therewith in an annular piston chamber defined between the body and the tubular element, and means for communicating to the piston chamber above the piston fluid pressure communicated to the underreamer via a drill string, the means for communicating fluid pressure to the piston chamber including duct means separate from the underreamer fluid flow passage for connecting the piston chamber to an annular fluid flow passage of a double wall drill string.

4. An underreamer according to claim 1 including annular piston means carried circumferentially of the exterior of the tubular element and movable therewith in an annular piston chamber defined between the body and the tubular element, and means for communicating to the piston chamber above the piston fluid pressure communicated to the underreamer via a drill string, the upper end of the tubular element in all axial positions of said element mating in the flow passage upper section above the piston means, the means communicating fluid pressure to the piston chamber including duct means in the body connecting between the piston chamber above the piston and the underreamer fluid flow passage upper portion above the position occupied by the upper end of the tubular element in its upper position.

5. An underreamer according to claim 1 including cam means carried by the tubular element cooperable with cam followers connected to the respective arms, the cam means and the cam followers being cooperatively arranged for moving the arms from their retracted to their opened positions in response to movement of the tubular elememt from its upper to its lower position, the cam means comprises a ring releasably carried by the tubular element circumferentially thereof and an outwardly extending lobe on the ring for each support arm, the ring being connected to the tubular element by a coupling requiring first axial movement of the ring along the tubular element and then only angular movement about the element, and including means securing the element from angular movement relative to the body and means securing the ring from angular movement relative to the tubular element.

6. An underreamer according to claim 1 wherein the tubular element comprises a reciprocable actuator operable in moving from its upper position to its lower position in the body to move the cutter means support arms from their retracted to their opened positions, the tubular element being resiliently biased in the body to its upper position, and wherein the upper position of the tubular element corresponds to a closed state of the underreamer and the lower position of the tubular element corresponds to an opened state of the underreamer, and including means for mechanically holding the underreamer in its opened state, and means for mechanically operating the underreamer from its opened to its closed state.

7. An underreamer according to claim 6 wherein the means for holding the underreamer in its opened state comprises resiliently biased detent means cooperable between the tubular element and the body in the lower position of the tubular element for holding the element in its lower position against the upward resilient bias on the element.

8. An underreamer according to claim 7 wherein the means for operating the underreamer from its opened to its closed state includes means responsive to downward force applied to the opened support arms for applying to the tubular element sufficient upward force to overcome the holding operation of the detent means.

9. An underreamer according to claim 8 including a sleeve disposed in the body circumferentially of the tubular element and slidable axially of the underreamer relative to the body and to the element, spring means biasing the sleeve upwardly relative to the body, stop means defining a limit of motion of the sleeve relative to the body, and wherein the cutter means support arms are mounted to the sleeve for pivotal motion about pivot axes fixed relative to the sleeve.

10. An underreamer according to claim 9 including cam means carried by the tubular element cooperable with cam followers connected to the respective cutter means support arms, the cam means and the cam followers being cooperatively arranged for moving the arms from their retracted to their opened positions in response to movement of the tubular element from its upper to its lower position, the cam means including selected cam surface portions configured so that when they are engaged by the cam followers and downward force is applied to the support arms, the reaction of such force on the tubular element has a substantial component upwardly on the element.

11. A borehole underreamer comprising a tubular body adapted at an upper end thereof for coaxial connection to a rotary drill string, a plurality of cutter means support arms having upper and lower ends, the arms being disposed at selected locations around the circumference of the body at a selected point therealong and being mounted at their upper ends for pivotal motion relative to the body between (a) retracted positions in which the arms are disposed essentially within the outer diameter of the body and (b) opened positions in which the arm lower ends are disposed a selected distance outwardly of the exterior of the body, cutter means mounted to the lower end of each arm and configured to extend essentially to the center of the body when the arm is in its retracted position, actuator means in the body selectively operable for moving the arms from their retracted to their opened positions, the actuator means including an open-ended tubular element movable downwardly in the body coaxially thereof during operation of the actuator means from (a) an upper position wherein the lower end of the element is disposed above the locations occupied by the cutter means in the retracted positions of the arms to (b) a lower position wherein the lower end of the element is disposed below said cutter means locations, the body having a fluid flow passage therealong comprised of upper and lower axial passage sections respectively above and below said cutter means retracted positions, the lower passage means including means cooperable with the lower end of the tubular element in the lower position of the element for connecting the passage upper and lower sections in fluid flow relation, the tubular element carrying an annular piston circumferentially of the exterior thereof in a piston chamber defined by the body circumferentially of the tubular element, the tubular element having an upper end a selected distance above the piston which in all positions of the element axially relative to the body is slidably sealed to the body above the piston chamber, and including duct means in the body in parallel flow relation to the underreamer axial fluid flow passage, the duct means having outlet ends to the piston chamber above the piston and inlet ends above the upper end of the tubular element in the upper position thereof communicating to fluid pressure presented to the underreamer via a drill string.

12. An underreamer according to claim 11 wherein the duct means inlet ends communicate to the upper end of the body separately from the axial flow passage for connecting the piston chamber to an annular fluid flow passage of a double-wall drill string.

13. An underreamer according to claim 11 wherein the duct means inlet ends communicate from the body to the axial flow passage above the upper end of the tubular element in its upper position.

14. A borehole underreamer comprising a tubular body adapted at an upper end thereof for coaxial connection to a rotary drill string, a plurality of cutter means support arms having upper and lower ends, the arms being disposed at selected locations around the circumference of the body at a selected point therealong and being mounted at their upper ends for pivotal motion relative to the body between (a) retracted positions in which the arms are disposed essentially within the outer diameter of the body and (b) opened positions in which the arm lower ends are disposed a selected distance outwardly of the exterior of the body, cutter means mounted to the lower end of each arm, actuator means in the body selectively operable for moving the arms from their retracted to their opened positions, the actuator means including an open-ended tubular element movable downwardly in the body coaxially thereof during operation of the actuator means, the body having an axial fluid flow passage at least partially therealong from the upper end of the body and opening from the body at the upper end thereof, the tubular element carrying an annular piston circumferentially of the exterior thereof in a piston chamber defined by the body circumferentially of the tubular element, the tubular element having an upper end a selected distance above the piston which in all positions of the element axially relative to the body is slidably sealed to the body above the piston chamber, and including duct means in the body in parallel flow relation to the underreamer axial fluid flow passage, the duct means having outlet ends to the piston chamber above the piston and inlet ends above the upper end of the tubular element in the upper position thereof communicating to fluid pressure presented to the underreamer via a drill string.

15. An underreamer according to claim 14 wherein the duct means inlet ends communicate to the upper end of the body separately from the axial flow passage for connecting the piston chamber to an annular fluid flow passage of a double-wall drill string.

16. An underreamer according to claim 14 wherein the duct means inlet ends communicate from the body to the axial flow passages above the upper end of the tubular element in its upper position.

17. A borehole underreamer comprising a tubular body adapted at an upper end thereof for coaxial connection to a rotary drill string, a plurality of cutter means support arms having upper and lower ends, the arms being disposed at selected locations around the circumference of the body at a selected point therealong and being mounted at their upper ends for pivotal motion relative to the body between (a) retracted positions in which the arms are disposed essentially within the outer diameter of the body and (b) opened positions in which the arm lower ends are disposed a selected distance outwardly of the exterior of the body, cutter means mounted to the lower end of each arm and configured to extend into the body when the arm is in its retracted position, actuator means in the body selectively operable for moving the arms from their retracted to their opened positions, the actuator means including an elongate actuator element movable downwardly in the body coaxially thereof from an upper position to a lower position during operation of the actuator means, the actuator element being operable in moving from its upper position to its lower position in the body to move the cutter support arms from their retracted to their opened positions, the upper position of the actuator element corresponding to a closed state of the underreamer and the lower position of the element corresponding to an opened state of the underreamer, means resiliently biasing the actuator element in the body to its upper position, means for mechanically holding the underreamer in its opened state, and means for mechanically operating the underreamer from its opened to its closed state.

18. An underreamer according to claim 17 wherein the means for holding the underreamer in its opened state comprises resiliently biased detent means cooperable between the actuator element and the body in the lower position of the actuator element for holding the element in its lower position against the upward resilient bias on the element.

19. An underreamer according to claim 18 wherein the means for operating the underreamer from its opened to its closed state includes means responsive to downward force applied to the opened support arms for applying to the actuator element sufficient upward force to overcome the holding operation of the detent means.

20. An underreamer according to claim 19 including a sleeve disposed in the body circumferentially of the actuator element and slidable axially of the underreamer relative to the body and to the element, spring means biasing the sleeve upwardly relative to the body, stop means defining a limit of motion of the sleeve relative to the body, and wherein the cutter means support arms are mounted to the sleeve for pivotal motion about pivot axes fixed relative to the sleeve.

21. An underreamer according to claim 20 including cam means carried by the actuator element cooperable with cam followers connected to the respective cutter means support arms, the cam means and the cam followers being cooperatively arranged for moving the arms from their retracted to their opened positions in response to movement of the actuator element from its upper to its lower position, the cam means including selected cam surface portions configured so that when they are engaged by the cam followers and downward force is applied to the support arms, the reaction of such force on the actuator element has a substantial component upwardly on the element.

22. A borehole underreamer comprising a tubular body adapted at an upper end thereof for coaxial connection to a rotary drill string, a plurality of cutter means support arms having upper and lower ends, the arms being disposed at selected locations around the circumference of the body at a selected point therealong and being mounted at their upper ends for pivotal motion relative to the body between (a) retracted positions in which the arms are disposed essentially within the outer diameter of the body and (b) opened positions in which the arm lower ends are disposed a selected distance outwardly of the exterior of the body, cutter means mounted to the lower end of each arm and configured to extend essentially to the center of the body when the arm is in its retracted position, actuator means in the body selectively operable for moving the arms from their retracted to their opened positions, the actuator means including an open-ended tubular element movable downwardly in the body coaxially thereof during operation of the actuator means from (a) an upper position wherein the lower end of the element is disposed above the locations occupied by the cutter means in the retracted positions of the arms to (b) a lower position wherein the lower end of the element is disposed below said cutter means locations, the body having a fluid flow passage therealong comprised of upper and lower axial passage sections respectively above and below said cutter means retracted positions, the lower passage means including means cooperable with the lower end of the tubular element in the lower position of the element for connecting the passage upper and lower sections in fluid flow relation, fluid discharge nozzles carried by the body below the cutter means support arms and directed toward the locations of the cutter means in the opened positions of the arms, and duct means for communicating the nozzles to the lower section of the underreamer fluid flow passage when the tubular element is in its lower position.

23. A borehole underreamer comprising a tubular body adapted at an upper end thereof for coaxial connection to a rotary drill string, a plurality of cutter means support arms having upper and lower ends, the arms being disposed at selected locations around the circumference of the body at a selected point therealong and being mounted at their upper ends for pivotal motion relative to the body between (a) retracted positions in which the arms are disposed essentially within the outer diameter of the body and (b) opened positions in which the arm lower ends are disposed a selected distance outwardly of the exterior of the body, cutter means mounted to the lower end of each arm and configured to extend essentially to the center of the body when the arm is in its retracted position, actuator means in the body selectively operable for moving the arms from their retracted to their opened positions, the actuator means including an open-ended tubular element movable downwardly in the body coaxially thereof during operation of the actuator means from (a) an upper position wherein the lower end of the element is disposed above the locations occupied by the cutter means in the retracted positions of the arms to (b) a lower position wherein the lower end of the element is disposed below said cutter means locations, the body having a fluid flow passage therealong comprised of upper and lower axial passage sections respectively above and below said cutter means retracted positions, the lower passage means including means cooperable with the lower end of the tubular element in the lower position of the element for connecting the passage upper and lower sections in fluid flow relation, the flow passage lower section comprising a bore axially in the body below the positions occupied in the body by the cutter means when the cutter means support arms are in their retracted positions, the bore having a diameter corresponding to the outer diameter of the tubular element at and closely adjacent to its lower end, the upper end of the bore being spaced below the lower end of the tubular element in its upper position by an amount less then the distance through which the tubular element moves in moving from its upper to its lower position.

24. An underreamer according to claim 23 including a sleeve disposed in the body bore and slidable therealong, the sleeve having an inner diameter corresponding to the inner diameter of the tubular element, means resiliently biasing the sleeve upwardly in the bore, and means defining a limit of upward movement of the sleeve in the bore in which the upper end of the sleeve substantially registers with the upper end of the bore to be engaged by and moved downwardly by the tubular element during movement of the tubular element to its lower position.

25. An underreamer according to claim 23 including nozzle means carried by the body below the retracted positions of the arms and the cutter means for discharging fluid applied thereto toward the locations of the cutter means in the opened positions of the arms, duct means in the body for supplying fluid to the nozzle means, and valve means operable in response to movement of the sleeve from its limit of upward movement for communicating the duct means to the lower section of the underreamer fluid flow passage.

26. An underreamer according to claim 25 wherein the duct means includes a chamber circumferentially of the sleeve, and the valve means comprises port means in the sleeve at a location therealong so defined that the port means are sealed from the chamber when the sleeve is at said limit but communicates between the flow passage lower section and the chamber when the sleeve is engaged by the tubular element and the element is at its lower position.

* * * * *